US011608574B2

(12) United States Patent
Myogi et al.

(10) Patent No.: US 11,608,574 B2
(45) Date of Patent: Mar. 21, 2023

(54) FRAME STRUCTURE OF LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 87 days.

(21) Appl. No.: 17/215,640

(22) Filed: Mar. 29, 2021

(65) Prior Publication Data

US 2021/0332508 A1 Oct. 28, 2021

(30) Foreign Application Priority Data

Apr. 22, 2020 (JP) ..... JP2020-075779

(51) Int. Cl.
*D03D 49/02* (2006.01)
*D03D 49/00* (2006.01)

(52) U.S. Cl.
CPC ..... *D03D 49/02* (2013.01)

(58) Field of Classification Search
CPC .... D03D 49/02; D03D 49/027; D03D 49/025; D03D 49/06; D03D 49/20
See application file for complete search history.

(56) References Cited

U.S. PATENT DOCUMENTS 1,294,809 A * 2/1919 Johnstone ..... D03D 49/06 139/97
2,489,557 A * 11/1949 Blanchard ..... D03D 49/025 139/1 R
2,585,167 A * 2/1952 Picanol ..... D03D 49/06 139/110
2,619,989 A * 12/1952 Sargent ..... D03D 29/00 139/33

(Continued)

FOREIGN PATENT DOCUMENTS

CN 204982247 U 1/2016
JP H05-027081 U 4/1993
JP H10-110355 A 4/1998

OTHER PUBLICATIONS

Sep. 7, 2021, European Search Report issued for related EP application No. 21165665.7.

*Primary Examiner* — Robert H Muromoto, Jr.
(74) *Attorney, Agent, or Firm* — Paratus Law Group, PLLC

(57) ABSTRACT

A frame structure of a loom includes a frame formed by connecting a pair of side frames, to each of which a beam support for supporting a warp beam is fixed, by a plurality of beam materials, and one or more pair of height position setting members arranged between a loom installation surface and each of the side frames. Each of the height position setting members is fixed to the installation surface and the corresponding side frame. The pair of height position setting members are provided as a support structure configured such that a fixed position with respect to the corresponding side frame on at least one of a let-off side and a take-up side is an inner surface or an outer surface of the side frame.

2 Claims, 3 Drawing Sheets

A—A

(56) References Cited

U.S. PATENT DOCUMENTS

| | | | | | |
|---|---|---|---|---|---|
| 3,858,619 | A * | 1/1975 | Berry | D03D 49/025 | 139/1 R |
| 4,757,842 | A * | 7/1988 | Honegger | D03D 49/027 | 139/1 R |
| 5,234,754 | A * | 8/1993 | Bache | C04B 28/04 | 106/725 |
| 5,611,974 | A * | 3/1997 | Welch | F16M 5/00 | 264/34 |
| 6,554,028 | B2 * | 4/2003 | Månsson | D03D 49/025 | 139/11 |

* cited by examiner

FRAME STRUCTURE OF LOOM

CROSS-REFERENCE TO RELATED APPLICATION

The present application claims priority from Japanese Patent Application No. 2020-075779, filed on Apr. 22, 2020, the entire subject matter of which is incorporated herein by reference.

BACKGROUND OF THE INVENTION

Field of the Invention

The disclosure relates to a frame structure of a loom that includes a frame formed by connecting a pair of side frames, to each of which a beam support for supporting a warp beam is fixed, by a plurality of beam materials, and one or more pair of height position setting members arranged between a loom installation surface and each of the side frames. Each of the height position setting members is fixed to the installation surface and the corresponding side frame.

Background Art

A typical loom includes, as a main configuration, a frame formed by connecting a pair of side frames having a housing shape by a plurality of beam materials. Further, a beam support for supporting a warp beam is attached to each side frame of the frame. Further, the loom includes a beating device having a rotary-driven rocking shaft and a reed supported by the rocking shaft, and the rocking shaft is supported by a pair of side frames of the frame.

In such a loom, it is known that violent vibration (so-called beating vibration) is generated in each side frame supporting the rocking shaft due to beating operation by the beating device during weaving. Therefore, each side frame of the frame is made to be firmly fixed to a loom installation surface by using anchor bolts, for example, as in the loom disclosed in PTL 1.

Further, as a known loom, for example, as disclosed in PTL 2, there is a loom in which the frame structure including the frame as described above is configured to include a raising member (height position setting member) mounted between a bottom surface (loom installation surface) and the frame. This is to make it possible to correspond to a plurality of types of warp beams having different diameters even while making the configuration of the side frame itself the same for each loom, by using such a height position setting member. In the frame structure using such a height position setting member, the height position setting member is fixed to the installation surface by anchor bolts and is fixed to a lower surface of the side frame by fixation bolts.

However, in the frame structure of the loom disclosed in PTL 2, problems such as deterioration in the quality of a woven fabric to be woven due to vibration of the side frame may occur. The details are as follows.

As described above, in the frame structure of the loom disclosed in PTL 2, the side frame is fixed to the height position setting member in a state where the corresponding side frame is placed on the height position setting member fixed to the installation surface. Therefore, the fixing of the side frame to the height position setting member using the fixation bolts as described above is performed by fastening the fixation bolts whose axial direction is oriented in an upper and lower direction. In such a frame structure, the fixing of the position of the side frame to the height position setting member in a horizontal direction is maintained by the weight of the side frame and the frictional force between the height position setting member (upper surface) and the side frame (lower surface) according to the fastening force by the fixation bolts.

Therefore, such a frame structure is slightly vulnerable to horizontal vibration in terms of vibration resistance. The beating vibration occurs so as to vibrate also in the horizontal direction including a front and rear direction (warp direction) and a width direction (weaving width direction) with respect to the frame (side frame). Therefore, in the frame structure as described above, the side frame may vibrate violently in the warp direction and the weaving width direction with the occurrence of the beating vibration. In particular, in recent years, the operation of the loom has tended to be increased in speed, and the vibration of the side frame becomes more violent with the increase in the speed of the loom.

When the side frame vibrates violently like that, each device supported by the side frame including the beating device vibrates, which may adversely affect the weaving and deteriorate the quality of the woven fabric to be woven. By the way, the case where the frame is directly fixed to the installation surface as in the loom disclosed in PTL 1 is superior in terms of vibration resistance. However, in that case, it becomes necessary to manufacture a plurality of types of side frames having different configurations so as to correspond to a plurality of types of warp beams having different diameters, which leads to an increase in the manufacturing cost of the loom.

PTL 1: JPH5-027081U

PTL 2: JPH10-110355A

SUMMARY OF THE INVENTION

In view of the frame structure of the loom in the related art as described above, an object of the disclosure is to provide a frame structure of a loom capable of improving vibration resistance against the above-described beating vibration in a loom including a frame structure having the height position setting member as described above.

The disclosure is based on a frame structure of a loom which includes a frame formed by connecting a pair of side frames, to each of which a beam support for supporting a warp beam is fixed, by a plurality of beam materials, and one or more pair of height position setting members arranged between a loom installation surface and each of the side frames, and in which each of the height position setting members is fixed to the loom installation surface and the corresponding side frame.

Moreover, in order to achieve the above object, in the frame structure of the loom of the disclosure described above, the pair of height position setting member are provided as a support structure configured such that a fixed position with respect to the corresponding side frame on at least one of a let-off side and a take-up side is an inner surface or an outer surface of the side frame.

Further, in the frame structure of the loom according to the disclosure, the frame structure may be configured such that the support structure is the pair of height position setting members disposed on the let-off side of the side frame.

Furthermore, the frame structure may be configured such that the beam support and the support structure are integrally formed. Further, the frame structure may be configured such that the fixed position of the support structure with respect to the side frame is the inner surface of the side frame.

According to the disclosure, in the frame structure of the loom including the pair of height position setting members as described above, the frame structure has improved vibration resistance by forming the pair of height position setting members as the support structure fixed to the side surface of the side frame on the let-off side and/or the take-up side. More details are as follows.

According to the frame structure of the loom of the disclosure, since each height position setting member is fixed to the side surface of the corresponding side frame, a fastening direction of the fixation bolts for such fixing (an axial direction of the fixation bolts in a fastened state) is parallel to a weaving width direction. In that frame structure, since the side frame is in a state of being received by the height position setting member on its side surface, the vibration in the weaving width direction generated in the side frame due to the beating vibration is received by the height position setting member directly fixed to the installation surface. Further, regarding the upper and lower direction, since the frictional force generated between each height position setting member and the corresponding side frame depends almost exclusively on the fastening with the fixation bolts, but the weight of the side frame is received at the fixed portion, the vibration resistance in the upper and lower direction is also about the same as the frame structure in the related art.

Therefore, the frame structure as a whole has improved vibration resistance as compared with the frame structure in the related art. As a result, according to the loom that adopted the frame structure, it possible to prevent the deterioration of the quality of the woven fabric due to beating vibration in weaving even while making the configuration of the side frame itself the same for each loom.

Further, in the frame structure of the loom according to the disclosure, the frame structure is configured such that the support structure is the height position setting member disposed on the let-off side of the side frame. In this way, the frame structure has improved vibration resistance against the vibration generated in the warp beam. in addition to improved vibration resistance against the beating vibration. More details are as follows.

In the loom, it is known that tension fluctuation of the warp occurs due to opening movement and beating operation during one cycle of weaving, and thus, the tension fluctuation becomes a vibratory force, and vibration (so-called beam vibration) in a rotation direction of the warp beam and a pull-out direction (upper and lower direction) of the warp may occur in the warp beam. Therefore, in addition to vibratory force due to the beating vibration via the rocking shaft as described above, vibratory force due to beam vibration via the beam support acts on the side frame. The vibratory force due to the beam vibration acts on the let-off side of the side frame. By the way, in the loom, the warp beam generally has a structure in which bearings fitted in barrel portions at both ends of the warp beam are supported by the beam supports. In such a loom, the vibratory force due to the beam vibration as described above acts on the side frame via the beam supports from the bearings.

In contrast, when the frame structure is configured such that the support structure according to the disclosure as described above is the height position setting member on the let-off side, in this frame structure, the side frame is received by the height position setting member on the side surface of the portion on the let-off side, which is the portion where the side frame receives the vibratory force due to the beam vibration. As a result, according to this configuration, the frame structure has improved vibration resistance against the beam vibration.

Further, in the frame structure configured such that the support structure is the height position setting member disposed on the let-off side of the side frame as described above, the frame structure has further improved vibration resistance against the beam vibration described above when the beam support that supports the warp beam is integrally formed in the support structure. Specifically, in the frame structure configured such that the support structure is the height position setting member disposed on the let-off side of the side frame as described above, the beam support is supported by the support structure when the beam support is configured to be integrally formed in the support structure. In this way, the frame structure has a configuration in which vibratory force due to the beam vibration does not act directly on the side frame. Therefore, according to this configuration, the frame structure has further improved vibration resistance against the beam vibration described above.

Further, in the frame structure of the loom of the disclosure, it is possible to more effectively improve the vibration resistance against the beating vibration when the frame structure is configured such that the fixed position of the support structure with respect to the side frame is the position of the inner surface of the side frame. Specifically, in a typical loom, the support position of the rocking shaft of the beating device that generates beating vibration as described above in the side frame is the inner surface side of the side frame. Therefore, when the frame structure is configured such that the fixed position of the support structure according to the disclosure with respect to the side frame is the inner surface of the side frame, the support position by the support structure is on the side that receives vibratory force due to the beating vibration, and thus, it is possible to more effectively improve the vibration resistance against the beating vibration.

DETAILED DESCRIPTION OF THE INVENTION

Figure 1:
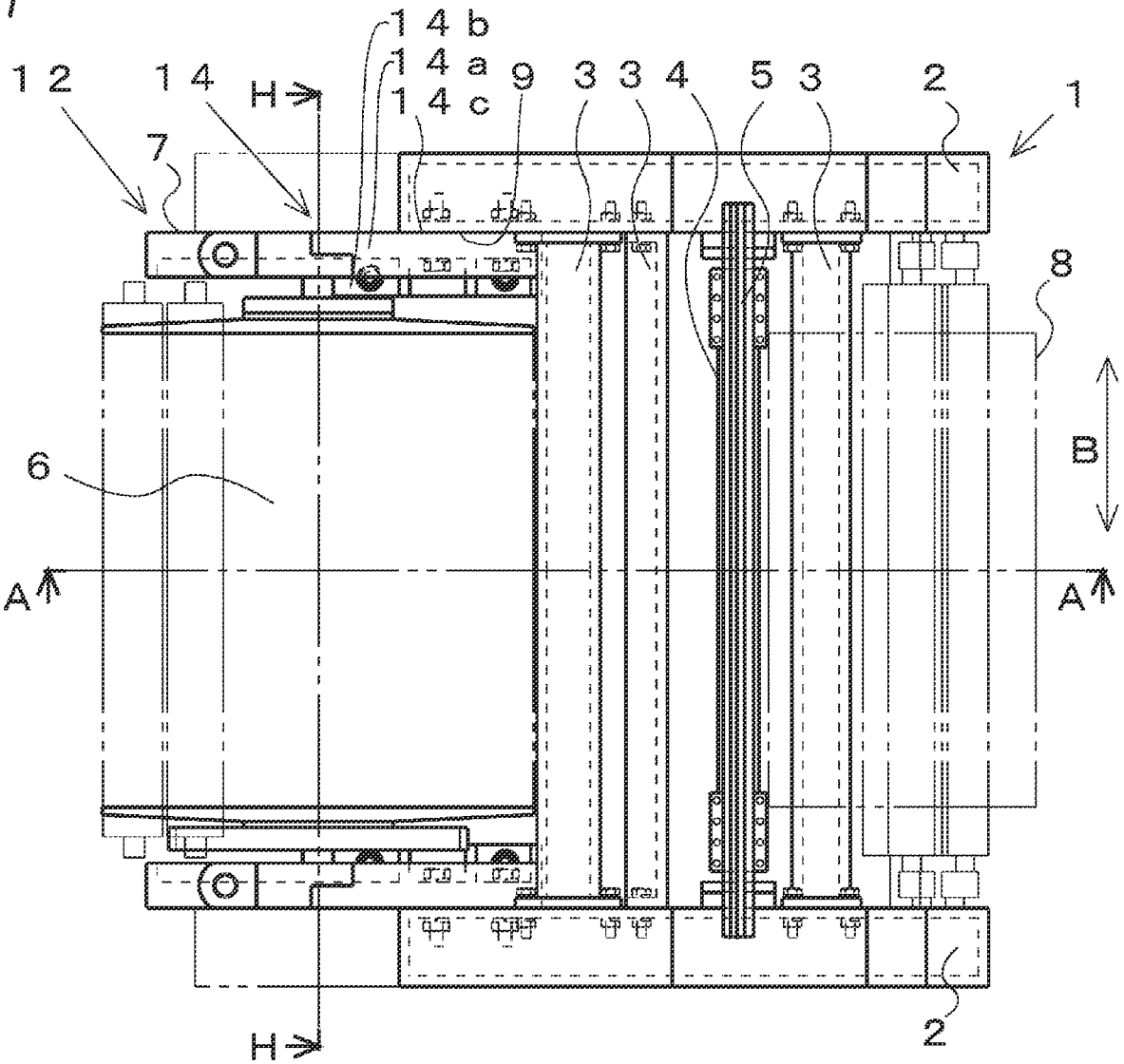
FIG. 1 is a top view of a frame structure of a loom to which the disclosure is applied.
Figure 2:
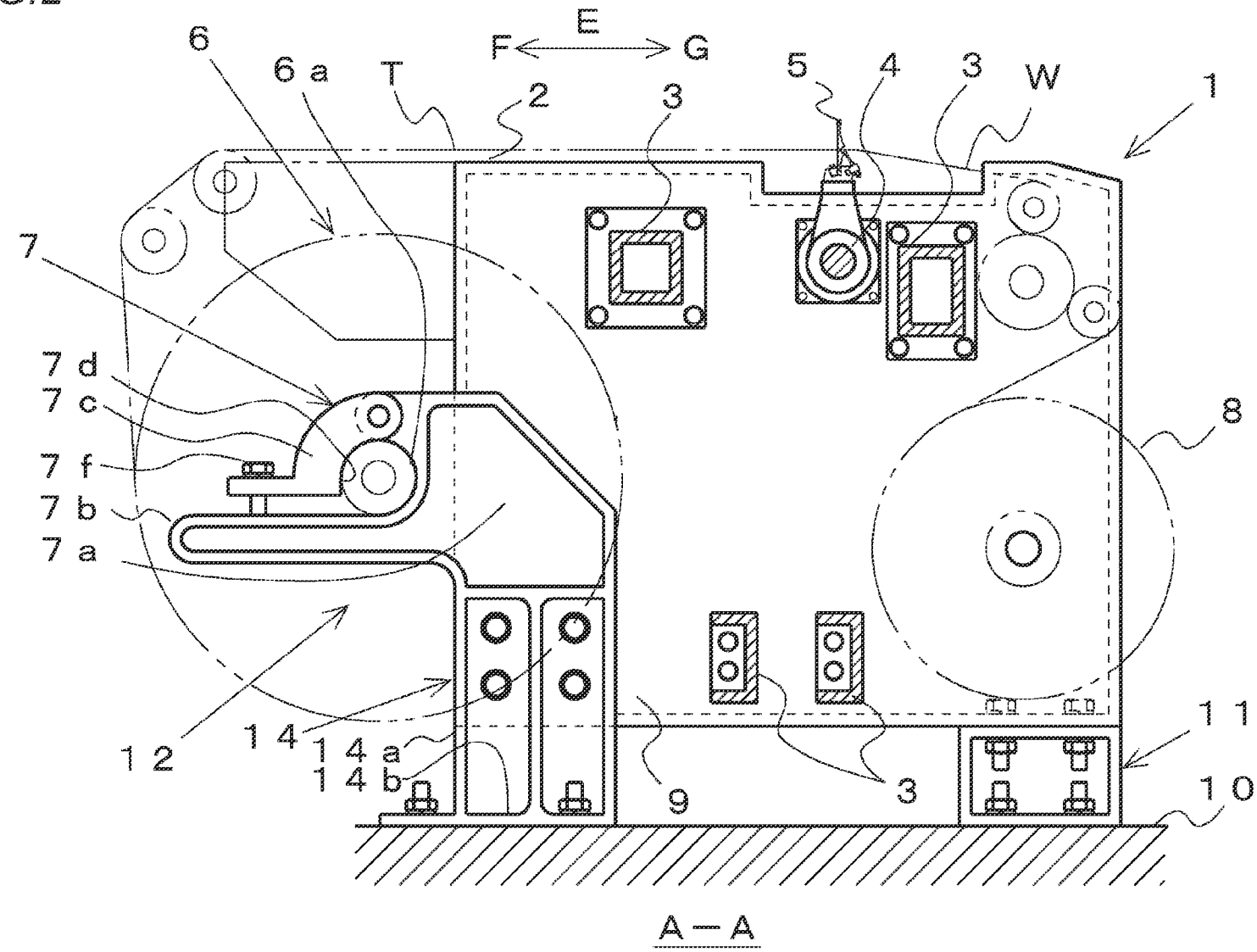
FIG. 2 is a sectional view taken along the line A-A in FIG. 1.
Figure 3:
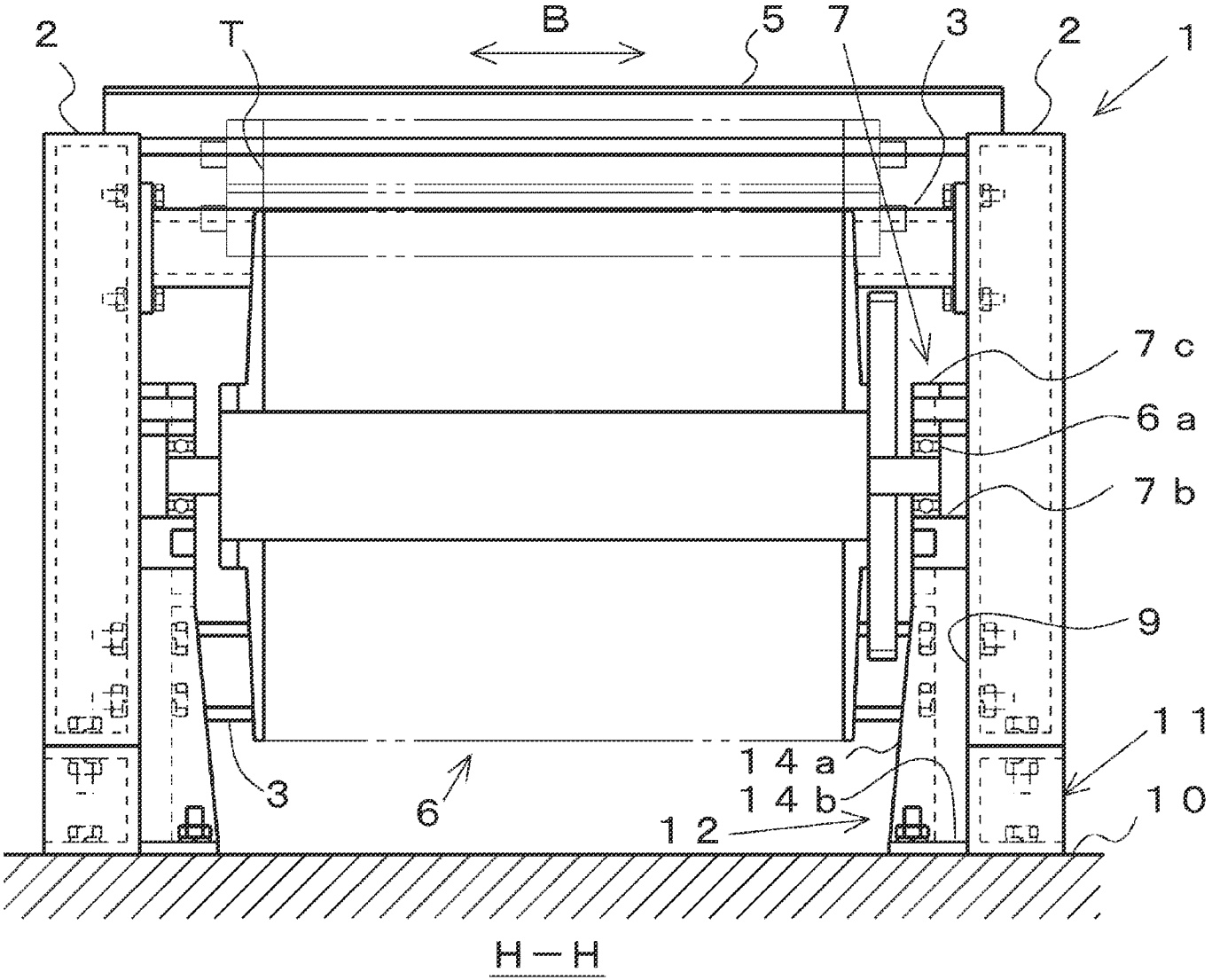
FIG. 3 is a sectional view taken along the line H-H in FIG. 1.

Hereinafter, an embodiment (the present embodiment) of a frame structure of a loom to which the disclosure is applied will be described with reference to FIGS. 1 to 3.

In a loom, a frame 1 includes a pair of side frames 2, 2 as a main configuration, and both side frames 2, 2 are connected by a plurality of beam materials 3. Each side frame 2 is formed in a housing shape having a space therein. Both side frames 2, 2 are connected by the beam materials 3 in a state of facing each other in a width direction (thickness direction) thereof.

Further, the loom is provided with a warp beam 6 for feeding a warp T so as to be supported by both side frames 2, 2 on one side in a front and rear direction (direction orthogonal to a longitudinal direction of the beam materials 3 in a plan view) thereof. Further, the loom is provided with a take-up beam 8 for winding a woven fabric so as to be supported by both side frames 2 on the other side in the front and rear direction thereof.

Furthermore, the loom includes a beating mechanism that swings and drives a reed 5. The beating mechanism is configured such that the reed 5 is supported by a rocking shaft 4 via a plurality of slay swords and the like. The rocking shaft 4 of the beating mechanism is oriented parallel to the beam materials 3 and is supported by the pair of side frames 2, 2 at both ends thereof.

In the frame structure of the loom including the frame 1 as described above, the disclosure is based on the premise that the frame structure is configured to include a pair of height position setting members disposed between a loom installation surface and the side frames on at least one of a let-off side (side where the warp beam 6 is provided) and a take-up side (side where the take-up beam 8 is provided). In the present embodiment, the frame structure is configured to include the height position setting members on both the let-off side and the take-up side.

Moreover, in the frame structure of the disclosure, the height position setting member on at least one of the let-off side and the take-up side is a support structure provided so as to be fixed to a side surface of the corresponding side frame 2. In the present embodiment, the height position setting member on the let-off side is the support structure. The details of the frame structure of the loom in the present embodiment are as follows.

First, as for the height position setting member on the take-up side, height position setting members 11 are provided in pairs so as to correspond to each of the side frames 2, 2. Each height position setting member 11 is a member that has a generally rectangular parallelepiped shape. The height position setting member 11 is formed to have a size in which the dimension (width dimension) in a short side direction of upper and lower surfaces forming a rectangle is substantially the same as the dimension of the side frame in the width direction. Each height position setting member 11 has a shape in which both side surfaces in the short side direction are opened and a wall is formed inside substantially at the center in the short side direction. Moreover, each height position setting member 11 is provided so as to be mounted between a lower surface of the corresponding side frame 2 and an installation surface 10.

Each height position setting member 11 on the take-up side is formed with a plurality of through holes which penetrate each of a lower side wall (lower wall) in contact with the installation surface 10 and an upper side wall (upper wall) in contact with the lower surface of the side frame 2 and through which bolts for fixing are inserted. Each height position setting member 11 is fixed to the installation surface 10 by inserting anchor bolts provided to protrude from the installation surface 10 into the through holes in the lower wall and screwing nuts into the anchor bolts. Further, each height position setting member 11 is fixed to the side frame 2 by inserting fixation bolts inserted into through holes formed in the lower surface of the corresponding side frame 2 into the through holes in the upper wall and screwing nuts into the fixation bolts.

On the other hand, as for the height position setting member on the let-off side, as described above, the height position setting member is formed as the support structure referred to in the disclosure. A typical loom includes a pair of beam supports for supporting a warp beam as described above, and the beam supports are attached to the side frames. In the present embodiment, the beam supports are formed integrally with the support structure. That is, the support structure of the present embodiment includes the beam supports and has a part (height position setting part) serving as a height position setting member and a part (beam support part) serving as a beam support. Such a support structure will be described in detail below.

A beam support part 7 itself has the same form as the beam support in the related art. The beam support part 7 includes a supporting portion 7*a* that has an arcuate supporting surface formed to receive bearings 6*a* fitted in barrel portions (not shown) at both ends of the warp beam, and a guide portion 7*b* that has an upper surface continuous with the supporting surface and extends from the supporting portion 7*a* in order to guide the warp beam toward the supporting portion 7*a*. The supporting portion 7*a* and the guide portion 7*b* are integrally formed.

Further, the beam support part 7 includes a clamp lever 7*c* for holding the warp beam 6 received by the supporting portion 7*a*. The clamp lever 7*c* is pivotably attached to the supporting portion 7*a*. The clamp lever 7*c* is provided to be able to pivot between a clamp position for holding the warp beam 6 and a release position for releasing the warp beam 6. Furthermore, the clamp lever 7*c* has an arcuate surface 7*d* that abuts against an outer peripheral surface of the bearing 6*a* of the warp beam 6 received by the supporting portion 7*a* in the state of being in the clamp position.

Further, the beam support part 7 includes a fixing unit 7*f* for fixing the clamp lever 7*c* to the guide portion 7*b* (making the clamp lever 7*c* non-pivotable with respect to the guide portion 7*b*) in a state where the clamp lever 7*c* is in the clamp position. The beam support part 7 is in a state of holding the warp beam 6 by fixing the clamp lever 7*c* to the guide portion 7*b* with the fixing unit 7*f* in a state where the warp beam 6 (the bearing 6*a*) is received by the supporting surface of the supporting portion 7*a*.

A height position setting part 14 includes a base portion 14*b* formed in a plate shape and serving as a base of a support structure 12, and a mounting portion 14*a* formed on the upper surface side of the base portion 14*b*. The base portion 14*b* has a substantially rectangular shape as viewed in a plate thickness direction, and has a size in which the dimension in the short side direction of its end surfaces (upper and lower surfaces) is substantially the same as the dimension of the side frame in the width direction.

Further, the mounting portion 14*a* has a substantially rectangular parallelepiped shape in appearance, and upper and lower surfaces thereof form a rectangular shape. Here, the mounting portion 14*a* has a housing shape and forms a shape in which one side surface (side wall) in the short side direction is open. The mounting portion 14*a* is formed integrally with the base portion 14*b* in a direction in which the short side direction (long side direction) of the upper and lower surfaces thereof coincides with the short side direction (long side direction) of the upper surface of the base portion 14*b*. Therefore, the lower side wall (lower wall) including the lower surface of the mounting portion 14*a* forms a part of the base portion 14*b*. By the way, in the illustrated example, ribs are formed in the inside of the mounting portion 14*a* substantially at the center in the long side direction so as to connect the lower surface (the base portion 14*b*) and the upper surface.

Further, the mounting portion 14*a* is configured such that the dimension in the short side direction of the lower surface is substantially the same as the dimension in the short side direction of the upper surface of the base portion 14*b*, and the dimension in the short side direction of the upper surface is substantially the same as the width dimension of the supporting portion 7*a* of the beam support part 7. Further, the dimension in the long side direction of the lower surface of the mounting portion 14*a* is slightly smaller than the dimension in the long side direction of the upper surface of the base portion 14*b*. Therefore, the height position setting part 14 is formed such that the base portion 14*b* protrudes in the long side direction with respect to the mounting portion 14*a*, as viewed in a plan view. Furthermore, the mounting portion 14*a* is configured such that the dimension (height dimension) in a height direction thereof is larger than the height dimension of the height position setting member 11 on the take-up side.

Moreover, in the support structure 12, the height position setting part 14 and the beam support part 7 are integrated such that the beam support part 7 is located above the mounting portion 14*a* of the height position setting part 14. More specifically, in the support structure 12, the height position setting part 14 and the beam support part 7 are integrally formed such that the width direction of the beam support part 7 coincides with the short side direction of the height position setting part 14, and the supporting portion 7*a* of the beam support part 7 is continuous above the mounting portion 14*a* of the height position setting part 14.

The pair of support structures 12, 12, which are the pair of height position setting members on the let-off side, are attached to the corresponding side frames 2 on the let-off side, respectively. Specifically, each support structure 12 is located at a position where the beam support part 7 is provided at a desired position for supporting the warp beam 6 in the front and rear direction. Each support structure 12 is provided inside the corresponding side frame 2 such that the side surface of the mounting portion 14*a* of the height position setting part 14 is in contact with the side frame 2. Moreover, each support structure 12 is fixed to the installation surface and the corresponding side frame 2.

Regarding the fixing of each support structure 12, the height position setting part 14 is formed with a plurality of through holes which penetrate each of the side wall including the side surface of the mounting portion 14*a* and the base portion 14*b* in the plate thickness direction and through which bolts for fixing are inserted. In the above-described arrangement, each support structure 12 is fixed to the side frame 2 by inserting fixation bolts inserted into the through holes in the mounting portion 14*a* into through holes formed in an inner surface 9 (side wall) of the corresponding side frame 2 and screwing nuts into the fixation bolts. Moreover, each support structure 12 is fixed to the installation surface 10 by inserting anchor bolts provided to protrude from the installation surface 10 into the through holes in the base portion 14*b* and screwing nuts into the anchor bolts.

Further, the support structure 12 integrally includes the beam support as the beam support part 7, as described above. The positions in the width direction of the beam support part 7 and the height position setting part 14 in the support structure 12 are the same. Therefore, as a result of each support structure 12 being fixed as described above, the position in the width direction of the bearing 6*a* of the warp beam 6 is on the inside with respect to the side frame 2 corresponding to the support structure 12 that supports the bearing 6*a*. That is, the position in the width direction of the bearing 6*a* is set to the same side as the fixed position of the support structure 12 that supports the bearing 6*a* with respect to the corresponding side frame 2.

As described above, in the frame structure of the present embodiment, the support structure 12 including the height position setting part 14 corresponding to the height position setting member on the let-off side is fixed to the corresponding side frame 2 so that its side surface is in contact with the inner surface 9 of the corresponding side frame 2. This fixing is performed by using fixation bolts and making the fastening direction parallel to the width direction of the side frame. In this way, vibration in the width direction generated in the side frame 2 due to beating vibration is received by the support structure 12 fixed to the installation surface 10, so that the frame structure has improved vibration resistance as compared with the frame structure in the related art.

Further, as described above, the fixed position of the support structure 12 with respect to the corresponding side frame 2 is set to the side of the inner surface 9 which is the supported side of the rocking shaft 4 in the corresponding side frame 2. That is, the side frame 2 is supported by the support structure 12 on the side where the side frame 2 receives a vibratory force due to the beating vibration in the width direction. Furthermore, in the present embodiment, out of the height position setting members on the let-offside and the take-up side, the height position setting member on the let-off side is set as the support structure according to the disclosure. That is, in this frame structure, the height position setting member on the let-offside on which vibratory force due to the beam vibration acts is set as the support structure according to the disclosure. As a result, the frame structure has improved vibration resistance against the beam vibration.

Moreover, in the frame structure of the present embodiment, the beam support part 7 corresponding to the beam support that supports the warp beam 6 is formed integrally in the support structure 12. That is, the frame structure is configured such that the beam support is supported not by the side frame 2 but by the height position setting member. As a result, the vibratory force due to the beam vibration does not act directly on the side frame 2, so that the frame structure has further improved vibration resistance against the beam vibration.

Further, in the frame structure of the present embodiment, as described above, the position in the width direction of the bearing 6*a* is set to the same side as the fixed position of the support structure 12 that supports the bearing 6*a* with respect to the corresponding side frame 2. As a result, the support position by the support structure 12 is set to the side in the width direction of the side frame 2 where the vibratory force due to the beam vibration is received, the frame structure is adapted to more effectively improve the vibration resistance against the beam vibration.

Although one embodiment of the frame structure of the loom according to the disclosure has been described above, the frame structure of the loom according to the disclosure is not limited to the above embodiments, and can be implemented in the following modified examples.

(1) Regarding the beam support, in the above embodiment, the beam support for the warp beam 6 is integrally formed as the beam support part 7 in the support structure 12. That is, in the above embodiment, the beam support (part serving as the beam support) and the height position setting member (part serving as the height position setting member) are integrally formed in the support structure. However, in the frame structure of the disclosure, the support structure is not limited to the one with which the beam support is formed integrally as described above, and may function as the height position setting member. In that case, in the example of the above embodiment, the support structure includes only the height position setting part 14 in the support structure 12.

Further, in that case, the beam support is provided separately from the support structure (height position setting member). In that case, regarding the attachment (support) of the beam support, the beam support may be directly attached to the side frame 2 as in the loom in the related art, but it is also possible to support the beam support so as to be attached to the support structure attached to the side frame 2. That is, in the case where the height position setting member on the let-off side is provided as the support structure, and the support structure and the beam support are formed separately, the beam support may be provided to be attached (supported) to the support structure. Even in that case, the vibratory resistance against the beam vibration is improved.

(2) In the above example, the support structure which is the height position setting member (or, includes the part serving as the height position setting member) is provided on the let-off side. In other words, the height position setting member on the let-off side is provided as the support structure referred to in the disclosure. However, in the frame structure of the disclosure, the support structure is not limited to the height position setting member on the let-off side as described above, and may be the height position setting member on the take-up side. That is, in the frame structure of the disclosure, the height position setting member on the let-off side and/or the take-up side may be provided as the support structure.

Further, in the above example, the frame structure of the loom includes the height position setting members on the let-offside and the take-up side. However, in the loom in the related art, the frame structure may be configured to include the height position setting member on only one of the let-offside and the take-up side. Therefore, also in the disclosure, the frame structure may include the height position setting member on only one of the let-off side and the take-up side, and the height position setting member may be the support structure.

(3) In the above embodiment, the pair of support structures are fixed to the corresponding side frames 2 so that their side surfaces are in contact with the inner surfaces 9 of the side frames 2, respectively. In other words, the fixed position of each support structure with respect to the corresponding side frame 2 is the inner surface 9. However, in the frame structure of the disclosure, as described above, the fixed position of the support structure on the let-off side and/or the take-up side is not limited to the inner surface 9, and may be an outer surface in the width direction of the side frame 2.

Furthermore, in the case where the support structure is provided on both the let-off side and the take-up side, the fixed positions of the support structure on the let-off side and the support structure on the take-up side may be the same side or the opposite side with respect to the inner surface and the outer surface of the side frame 2. That is, the fixed positions of both the support structure on the let-off side and the support structure on the take-up side may be the inner surface or the outer surface, or one of the fixed positions may be the inner surface and the other of the fixed positions may be the outer surface.

In the case where the height position setting member on the let-off side is provided as the support structure as in the above embodiment, and the beam support is integrally formed with the support structure (or, is supported by a separate support structure), naturally, the warp beam 6 has a configuration according to an interval between the beam supports in the width direction in that case when the fixed position is the outer surface. In that case, the position in the width direction of the bearing 6*a* of the warp beam 6 in a state where the warp beam 6 is held by the beam support is on the outside with respect to the side frame 2, similarly to the fixed position.

Further, in the case where the height position setting member on the let-off side is provided as the support structure, and the beam support is provided separately from the support structure as described above, the position of the beam support and the fixed position in the width direction with respect to the side frame 2 may be not on the same side as described above. That is, the frame structure may be configured so that the beam support is attached to the outer surface with the fixed position as the inner surface or vice versa. In that case, the position of the bearing 6*a* and the fixed position in the width direction with respect to the side frame 2 are different positions on the inside and the outside.

Further, in the loom (frame structure), the attachment position of the beam support with respect to the side frame 2 is not limited to the inner surface or the outer surface of the side frame 2, and there are also looms configured such that the beam support is attached to a rear surface of the side frame 2. Furthermore, regarding the configuration of the beam support itself, even when the beam support is attached to the inner surface or the outer surface of the side frame 2, the beam support may be formed to protrude toward the side frame 2 from the portion where the guide portion is attached to the side frame 2, and the supporting surface may be arranged between the inner surface and the outer surface of the side frame 2.

In the case of these configurations, the position in the width direction of the bearing 6*a* of the warp beam 6 in the state where the warp beam 6 is held by the beam support is located between the inner surface and the outer surface of the side frame 2. Tat is, in the frame structure in that case, the position of the bearing 6*a* in the width direction with respect to the side frame 2 is different from both the inner surface and the outer surface of the side frame 2. As such, the frame structure of the disclosure may have a configuration in which the position of the bearing 6*a* in the state where the warp beam 6 is supported by the beam support is different from both the same side as the fixed position and the opposite side of the fixed position as described above, in the positional relationship in the width direction with respect to the side frame 2.

The disclosure is not limited to any of the embodiments described above, and can be appropriately modified without departing from the spirit of the disclosure.

What is claimed is:

1. A frame structure of a loom comprising:

a frame formed by connecting a pair of side frames, to each of which a beam support for supporting a warp beam is fixed, by a plurality of beam materials, and one or more pair of height position setting members arranged between a loom installation surface and each of the side frames, wherein each of the height position setting members is fixed to the installation surface and the corresponding side frame, a pair of the height position setting members on a let-off side of the loom are provided as a support structure configured such that a fixed position with respect to the corresponding side frame is an inner surface or an outer surface of the side frame, and the beam support is:

included in the support structure and the beam support is integrally formed with the height position setting members; or formed separately from the height position setting members which are provided as the support structure, and the beam support is attached to the support structure above the support structure and at a same position as the support structure in a width direction of the loom.

2. The frame structure of the loom according to claim 1, wherein the fixed position of the support structure with respect to the corresponding side frame is the inner surface.

* * * * *